United States Patent [19]

Crespin et al.

[11] Patent Number: 4,961,442

[45] Date of Patent: Oct. 9, 1990

[54] DYNAMIC CONTAINMENT DEVICE

[75] Inventors: Jean-Pierre Crespin, Chinon; Frederic Saulay, La Chartre Sur Le Loir, both of France

[73] Assignee: Polinorsud, France

[21] Appl. No.: 322,671

[22] Filed: Mar. 13, 1989

[30] Foreign Application Priority Data

Mar. 18, 1988 [FR] France ..... 8803841

[51] Int. Cl.[5] ..... G21F 9/02

[52] U.S. Cl. ..... 137/312; 137/315; 137/561 R; 98/115.1

[58] Field of Search ..... 137/312, 315, 561 R; 98/115.1, 42.06; 251/128

[56] References Cited

U.S. PATENT DOCUMENTS

| | | | |
|---|---|---|---|
| 3,127,462 | 3/1964 | Erni et al. | 98/115.1 X |
| 3,188,936 | 6/1965 | Nordstrom et al. | 98/36 |
| 3,437,558 | 4/1969 | Gunson et al. | 376/264 |
| 3,592,121 | 7/1971 | Lundy | 98/115.1 X |
| 4,505,190 | 3/1985 | Fink et al. | 98/115.1 |
| 4,684,492 | 8/1987 | Kunz et al. | 137/315 X |
| 4,708,177 | 11/1987 | Roberts | 98/115.1 X |

FOREIGN PATENT DOCUMENTS 0043394 1/1982 European Pat. Off. .

*Primary Examiner*—John Rivell

*Attorney, Agent, or Firm*—Oliff & Berridge

[57] ABSTRACT

The present invention relates to a dynamic containment device, outside and in the vicinity of an orifice of an opening cavity for example an opening of a valve. A device according to the invention comprises a hub for collecting by aspiration, comprising a plurality of unitary elements, the overall profile of which corresponds substantially to the contour of the border of the orifice of the said cavity, as well as a plurality of flexible conduits communicating, on the one hand, with each unitary element and, on the other hand, with an aspiration conduit. The invention is applied, in particular, to the partial decontamination of primary circuits of a nuclear power station.

7 Claims, 5 Drawing Sheets

DYNAMIC CONTAINMENT DEVICE

TECHNICAL FIELD

The present invention relates to a dynamic entertainment device, outside and in the vicinity of an orifice of an opening cavity, for example the opening of a valve.

BACKGROUND OF THE INVENTION

In the nuclear or chemical industry, when the industrial installations concerned are shut down, various maintenance, repair or servicing operations are carried out on the fluid circulation circuits.

In operation, certain circuits of the same installations carry products and materials which are toxic, contaminating or polluting, and it is not sufficient to have entirely evacuated the pipes, valves or chambers on which an operator has to take action, in order to protect that operator against any contact with the toxic products. Furthermore, at any open place of the circuit, within which the operator takes action, it is necessary to aspirate permanently the internal atmosphere, in order to direct a residual toxic gaseous flow away from the person taking action.

An example taken from the nuclear industry will enable the constraints expressed previously to be understood. When a nuclear power station is shut down, after having evacuated the primary cooling circuit, action is taken at various open places of the latter, for example in the opening of a valve, to undertake manually various repair or servicing operations. The internal residual atmosphere, within the open circuit, remains contaminating, in the sense that it can be assimilated to a suspension of radioactive particles, even if the radioactivity of the latter is frequently of short life.

Such action must therefore be taken while protecting the body of the person taking action against any contact with this contaminating residual atmosphere.

To this end, in accordance with U.S. Pat. No. 3,437,558, and more particularly in accordance with the embodiment described with reference to FIG. 4 of the latter, a containment device has been proposed, comprising:

a means for collecting by aspiration, which means is placed in position on the border of the orifice of the opening cavity, in the specific case the open vessel of a nuclear reactor; this collecting means comprises two collecting rings disposed opposite one another on the said border, but separated from one another, having together a profile open along a diameter of the circular opening of the reactor, this profile corresponding to the contour of the border of the latter; each ring has a U-shaped cross-section open towards the interior of the reactor, and comprises a plurality of aspiration openings, in all cases directed towards the interior of the reactor;

a plurality of outlet conduits each communicating, at one end, with a single evacuation conduit, connected to a vacuum means, and, at the other end, with the opening of a collector.

This device, consisting of rigid elements, is installed at a fixed station throughout the entire duration of the works. As such, this device cannot be used in a mobile works, repeatedly necessitating the assembly and the demounting, by the operator, of any dynamic containment device. Moreover, the placing in position of the latter must be undertaken rapidly, in order to limit the materials taken in by the operator in an ionizing environment.

SUMMARY OF THE INVENTION

The subject of the present invention is therefore a dynamic containment device, which can be assembled and demounted at will, in a particularly simple and rapid manner.

According to the present invention, the collecting means consists of a plurality of unitary elements, which can be placed in position in an adjacent manner on the border of the orifice, each comprising an aspiration opening, and a corresponding plurality of flexible output conduits connecting the said openings to a single linkage adaptor, which is connected to the evacuation conduit.

A containment device according to the invention further provides the following advantages.

First of all, its modular design permits it to be folded with a limited space requirement in volume terms, which improves the possibilities of circulation on the active site.

It can be constructed of plastic material, which avoids any aggression or erosion of the environment, and which is also able to "collect" contaminating dust.

BRIEF DESCRIPTION OF THE DRAWINGS

The present invention is now described with reference to the accompanying drawings, in which.

DETAILED DESCRIPTION OF PREFERRED EMBODIMENTS

Figure 1:
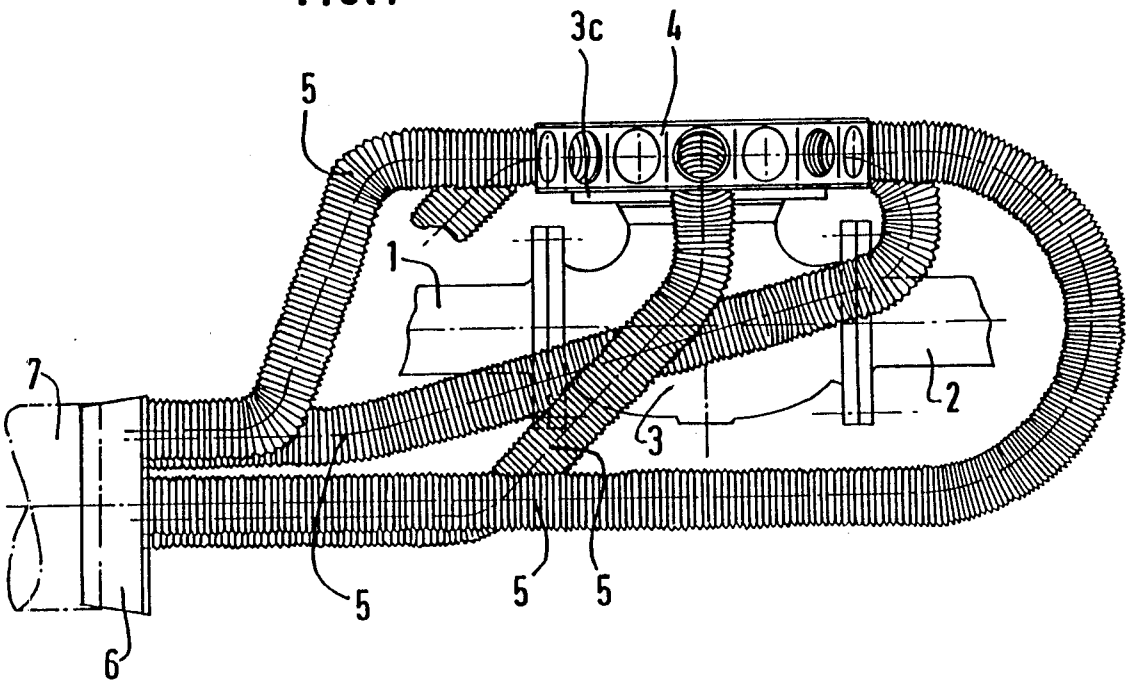
FIG. 1 represents a containment device in accordance with the present invention, according to a first embodiment of the latter, partially in cross-section, in position on the border of an orifice of an opening cavity, in the present case an open valve.
Figure 2:
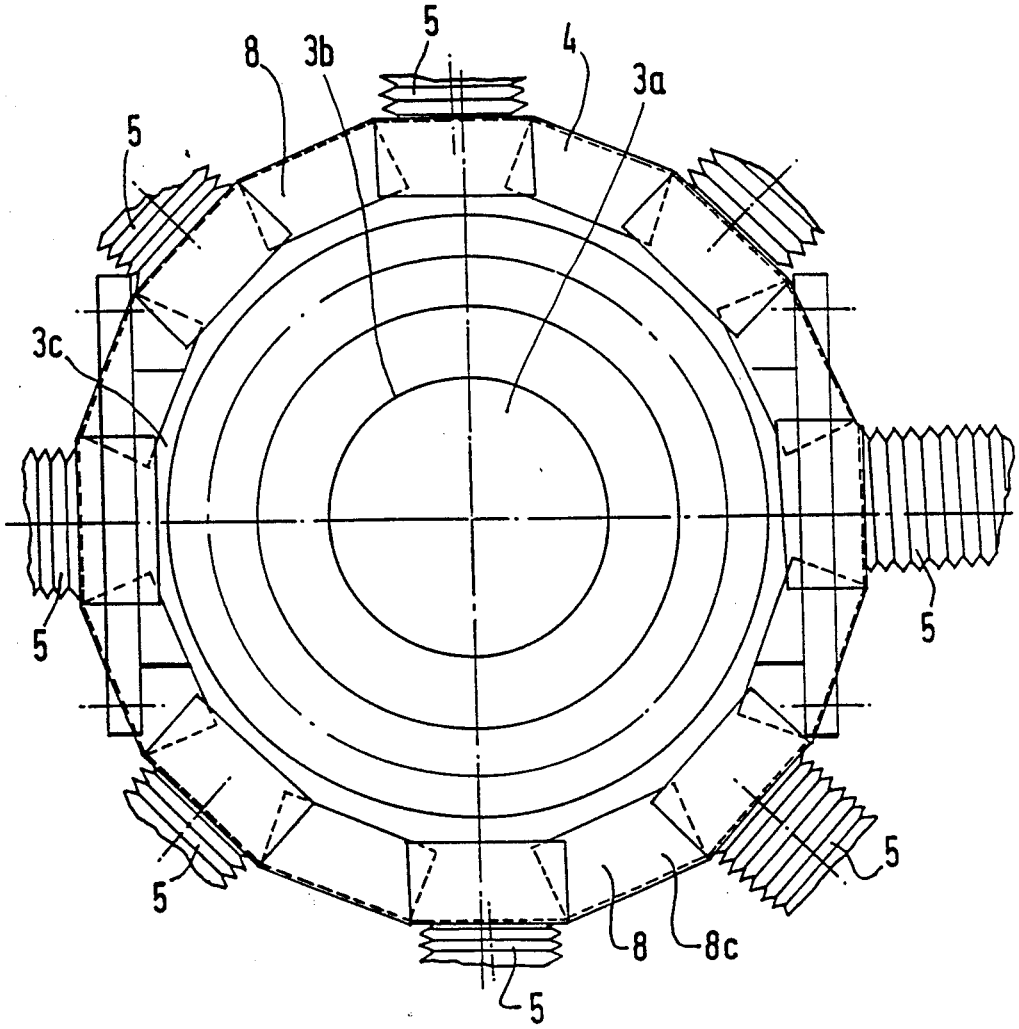
FIG. 2 represents, in top plan view, the containment device represented in FIG. 1.
Figure 4:
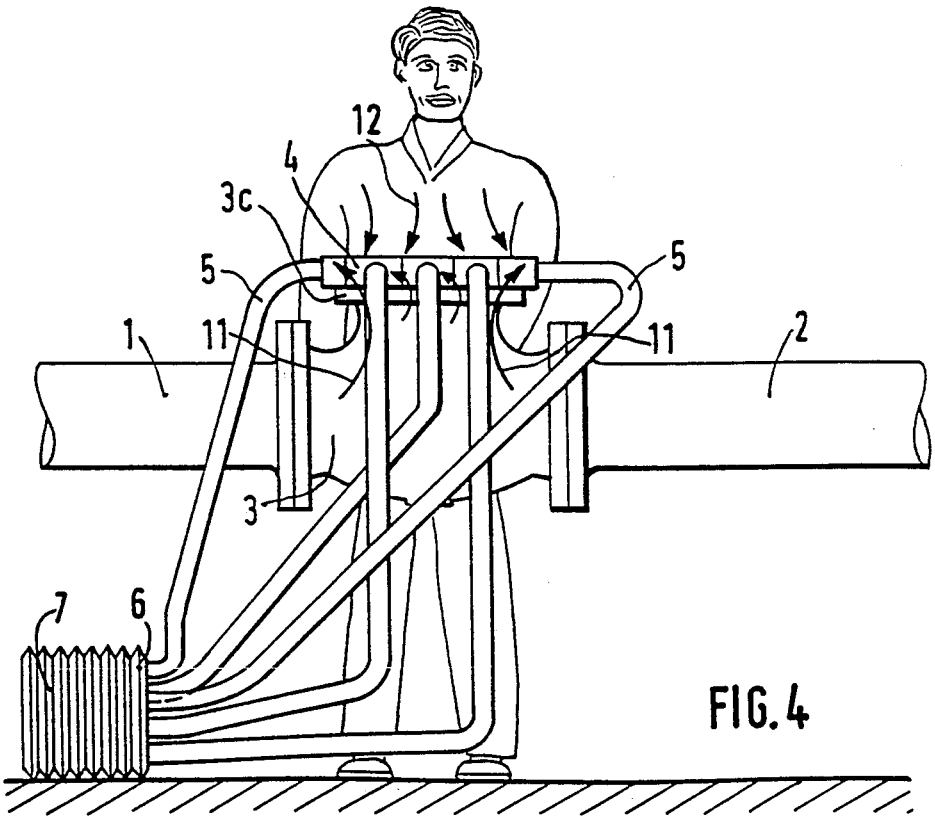
FIG. 4 explains the operation of a dynamic containment device according to FIGS. 1 to 3.

FIGS. 1, 2 and 4 represent a contaminated circuit, for example the primary circuit of a nuclear power station, in the form of two conduits (1) and (2), which are connected to one another by a valve (3), which is demounted, in such a manner that it constitutes, within the meaning of the present invention, a cavity which opens (3*a*) by an orifice (3*b*) comprising a border (3*c*).

Figure 8:
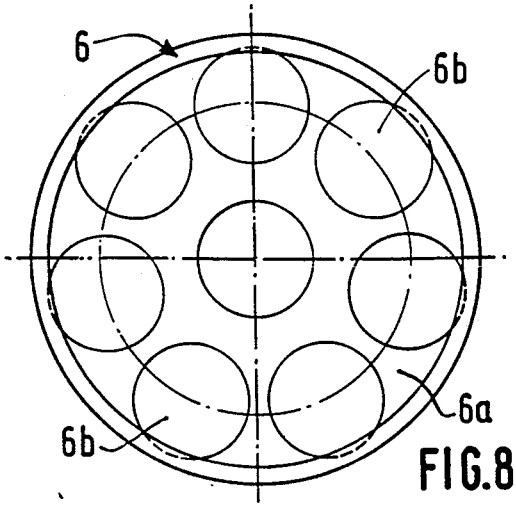
FIG. 8 represents a front view of a linkage adaptor forming part of a dynamic containment device according to the invention.
Figure 9:
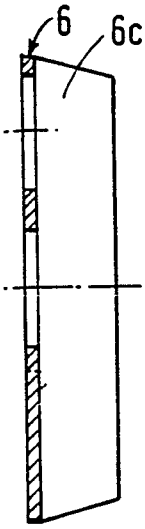
FIG. 9 represents a vertical cross-sectional view of the adaptor represented in FIG. 8.

A dynamic containment device according to the present invention is intended to be placed in position outside and in the vicinity of an orifice such as (3*b*), of an opening cavity such as (3*a*). This device is essentially constructed of plastic material, and comprises:

a means (4) for collecting by aspiration, having the shape of a gutter, the closed circular profile of which corresponds to the circular contour of the border (3*c*) of the orifice (3*b*) of the cavity (3*a*), the opening of this gutter (4) being directed towards the interior of the cavity (3*a*);

a plurality of output conduits (5), having the form of flexible pipes, disposed transversely in relation to the output direction of the orifice (3*a*), in the present case radially, and communicating with the interior of the gutter (4);

a linkage adaptor (6), more specifically represented in FIGS. 8 and 9, communicating, at one end, with all the output conduits (5), and, at the other end, with a conduit (7) or sheath for the evacuation of a gaseous current to a vacuum means, for example a cycling device, not shown.

Figure 3:
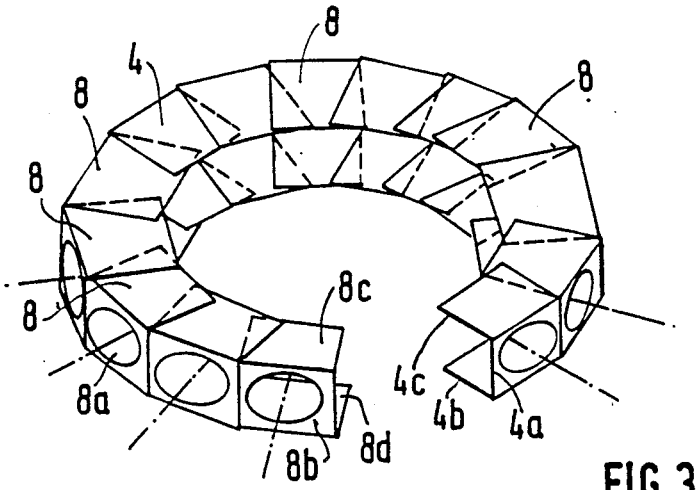
FIG. 3 represents, in a simplified manner, the collecting means in the form of a gutter, forming part of the containment device represented in FIGS. 1 and 2.

In terms of the construction as shown in FIG. 3, the collecting gutter (4) has a U-shaped profile, the interior of which is directed towards the centre of the circumference along which the same gutter is conformed. In transverse profile, more specifically, the gutter exhibits a flat base (4*a*) and two perpendicular wings (4*b*) and (4*c*), which are spaced from one another. Such a gutter is composed of a plurality of unitary elements (8), constructed, for example, of plastic material, likewise in a U shape, and thus exhibiting a flat base (8*b*) and two perpendicular wings (8*c*) (8*d*), one being the upper wing and the other the lower wing; the flat base (8*b*) of one element (8) comprises a circular aspiration opening (8*a*), for the assembly, by friction and resilience, of a flexible outlet pipe (5). All these unitary elements (8), which are identical as regards their profile, their form and their dimensions, are placed in position on the border (3*c*), assembled and articulated in an adjacent manner, to one another, according to the profile, whether closed or not, of the gutter, as represented in FIG. 3.

According to the embodiment represented in FIGS. 1 to 4, all the lower wings (8*d*) of the various elements (8) are independent of one another, separated from one another, and partially overlap in the aforementioned conformation; the same applies to the upper wings (8*c*). Furthermore, the vertical bases (8*b*) of the various elements (8) are connected and articulated to one another, whether or not in a demountable manner, for example by a hinge.

As regards the linkage adaptor (6) represented in FIGS. 8 and 9, this is present in the manner of a frustum of a cone and comprises a front face (6*a*) comprising a plurality of circular orifices (6*b*) each connected in a sealed manner, for example by hard force fitting, with the other end of the said conduit, opposite to the corresponding element 8 of gutter (4). The frustoconical wall (6*c*) is itself assembled, in a sealed manner, with the flexible conduit for evacuation (7) to the cycling device.

Figure 10:
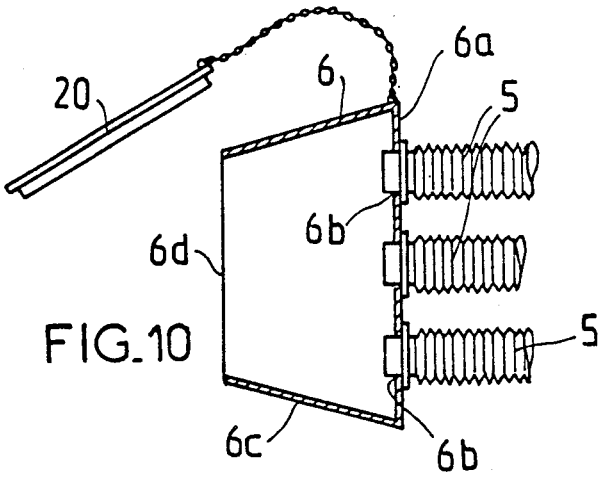
FIG. 10 represents a vertical cross-sectional view of another adaptor according to the present invention.

According to FIG. 10, the opening (6*d*) of the frustoconical wall (6*c*) comprises a removable closing cover (20), permitting the containment of any contamination during the period of non-use of the device according to the invention.

Figure 5:
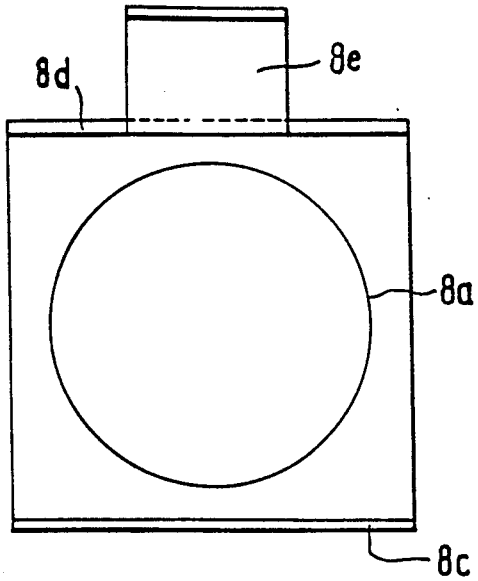
FIG. 5 represents a front view of a unitary element forming part of the collecting means of a containment device according to a second embodiment of the present invention.
Figure 6:
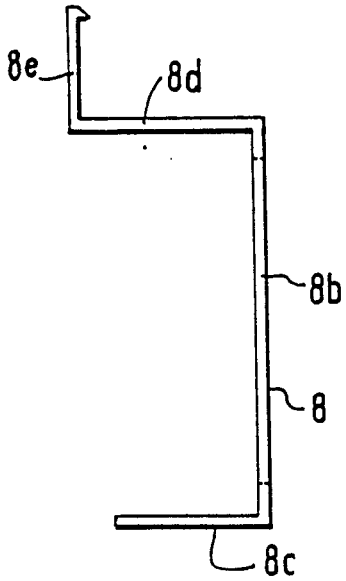
FIG. 6 represents a side view of the unitary element represented in FIG. 5.
Figure 7:
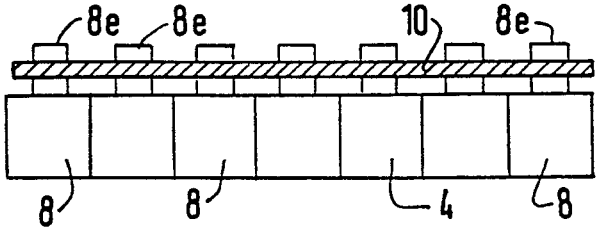
FIG. 7 represents the mode of assembly of the unitary elements according to FIGS. 5 and 6, to form an evacuation collecting means according to this second embodiment of the invention.

In accordance with the embodiments according to FIGS. 5 and 6, and in contrast to the first embodiment described previously, at the start, all the unitary elements (8) are independent of one another, while exhibiting a U-shaped profile as described previously. However, each element (8) comprises a tab (8*e*) disposed outside the gutter (4), parallel to the vertical base (8*b*), serving to support a collar (10*a*) (compare FIG. 7), which encircles the various elements (8), placed in position on the border (3*c*), and then assembled to one another in a contiguous manner.

It must be understood that the profile espoused by the gutter (4), in a manner corresponding to the border (3*c*), may be closed as represented in FIG. 2, or open at all appropriate places, as represented in FIG. 3.

The use of a containment device as previously described takes place in the following manner.

The gutter (4) is assembled or obtained from the previously described unitary elements (8), by being conformed to the geometry of the opening or border (3*c*) of the opening cavity (3*a*); the gutter (4) is therefore finally of variable conformation. This gutter (4) conformed in this manner is applied flat to the border (3*c*), in a quasi-sealed manner between the lower wing (4*b*) and the border (3*c*). Then, the cycling device or vacuum means is activated, by means of which a gaseous current is evacuated through the evacuation conduit (7), from an external aspiration zone, consisting of the interior of the gutter (4), adjacent to the orifice (3*b*), to the vacuum means (not represented).

More specifically:

the external aspiration zone defined previously has a contour, whether closed or not, which is substantially identical to and adjacent to the border (3*c*) of the orifice (3*b*) of the opening cavity (3*a*), by means of which, as represented by the arrows (11), the atmosphere within the cavity (3) is immediately aspirated outside the latter, in transverse directions, in the present case radial directions, in relation to the outlet direction of the orifice (3*a*);

the atmosphere collected within the gutter (4) is distributed in a plurality of gaseous outlet streams, in all cases of transverse directions, ducted through the conduit (5);

the outlet gas streams are then collected, through the linkage adaptor (6), according to the gas current (7) to the vacuum means (not represented);

immediately above the gutter (4), the ambient air is aspirated through the top, within the cavity (3*a*), and thus pushes back, in the direction of the arrows (12), the whole or a part of the contaminated atmosphere, which would be capable of escaping from the aspiration of the gutter (4).

Thus, in total, an efficient dynamic containment is obtained, resulting in a quasi-absence of contaminated atmosphere above the valve (3), in particular within the zone in which the operator is situated. The latter can thus work without ventilated protective clothing, with simple gloves enabling him to penetrate within the cavity (3).

Figure 11:
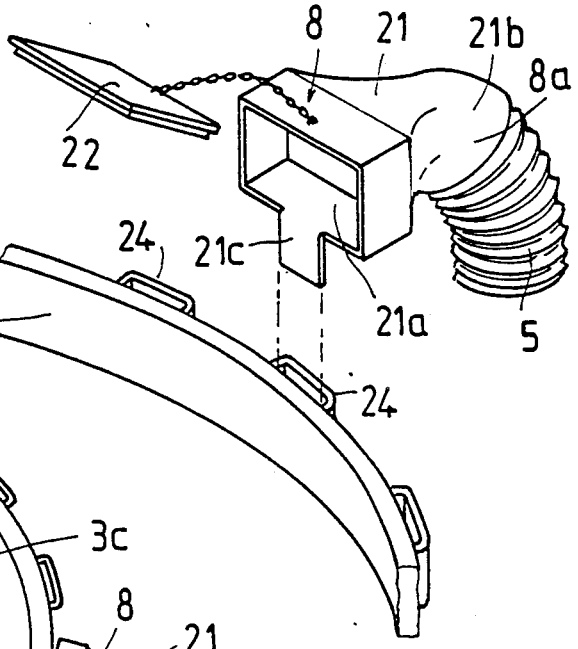
FIG. 11 represents a perspective view of an evacuation collecting means according to a third embodiment of the invention.
Figure 12:
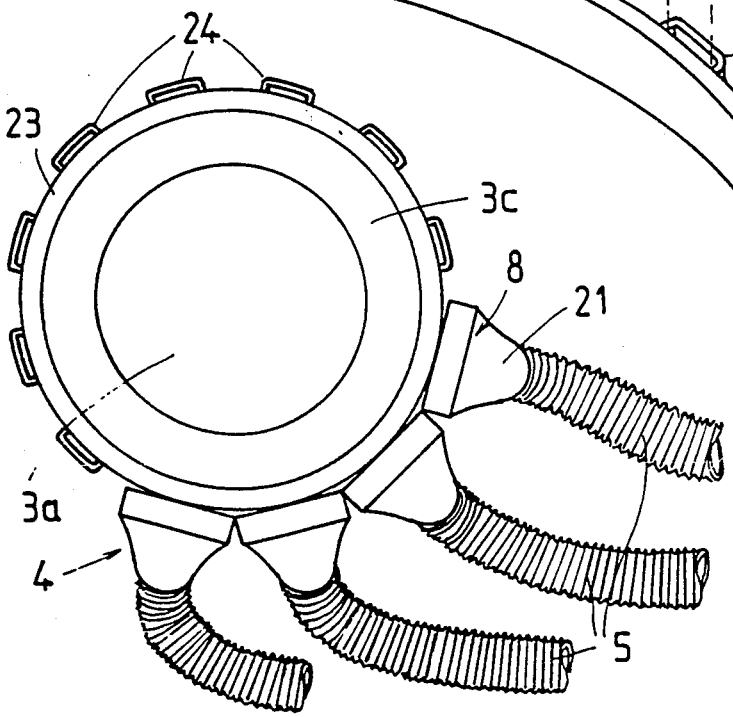
FIG. 12 represents a top plan view of the collecting means according to FIG. 11, placed in position on the opening of an open valve.

According to the third embodiment of the invention, and with reference to FIGS. 11 and 12, the various unitary elements (8) of the collector are entirely independent of one another. Each element (8) consists of a nozzle (21) forming a rectangular aspiration mouth (21*a*), directed towards the interior of the opening cavity (3*a*), once the nozzle is placed in position on the border (3*c*) as described hereinbelow. The part (21*b*) of the nozzle (21), of tubular form, opposite to the opening (21*a*), forms an opening (8*a*) connected to a flexible outlet conduit (5). Each joining piece comprises a removable fixing component (21*c*), having the form of a lower tab situated in the plane of the opening (21*a*). Each nozzle comprises a closing cover (22), permitting the containment of any contamination within the containment device, during the period of non-use of the latter.

Moreover, the containment device comprises a band (23), with means (not shown) for fastening the two strands of the latter, the whole permitting the encircling of borders (3*c*) of various diameters. This band comprises a plurality of hooking means (24), in the form of external plates (24), permitting the receiving of the tabs (21*a*) of the various nozzle (21) respectively.

Thus, according to this embodiment, it is possible to dispose at will the nozzle (21) opposite the border (3*c*), to obtain a collecting means (4) according to the conformation to the profile desired by the operator. Moreover, the removable nature of each nozzle (21), in relation to the border (3*c*), permits the temporary withdrawal thereof from the latter, as a function of the requirements for action on the opening cavity, for example for the passage of a tooling.

As indicated previously, the present invention cannot be limited to the field of the nuclear industry, and may be applied in other industries where it is necessary to take action on circuits containing a toxic residual atmosphere.

I claim:

1. A dynamic containment device for use outside and in the vicinity of an orifice, comprising:

means for collecting by aspiration, said means for collecting being capable of corresponding in profile to a contour of a border of an orifice, said means for collecting including a plurality of unitary elements capable of being placed in an adjacent manner in position on a border of an orifice, each unitary element including an aspiration opening; and a plurality of flexible outlet conduits corresponding in number to said aspiration openings, each of said flexible outlet conduits attached at a first end to one of said aspiration openings, an evacuation conduit capable of being connected to a vacuum means, and a single linkage adaptor connected between said evacuation conduit and second ends of said flexible outlet conduits.

2. The device according to claim 1, wherein each unitary element has the form of a gutter, directed towards the interior of the orifice once said unitary element is placed in position on the border of said orifice.

3. The device according to claim 2, wherein the unitary elements, each have the same profile, and are capable of being assembled to one another according to the profile of the border of the orifice.

4. The device according to claim 2, wherein the unitary elements each have the same profile, and are articulated to one another according to the profile of the border of the orifice.

5. The device according to claim 4, wherein each unitary element comprises a tab disposed outside the gutter, serving to support a collar encircling the elements articulated to one another.

6. The device according to claim 1, wherein each unitary element is a nozzle including an aspiration mouth, directed towards the interior of the orifice once said element is placed in position on the border of said orifice.

7. The device according to claim 1, wherein the unitary elements are independent of one another, each unitary element including a removable fixing component wherein a fixing band is further provided, said fixing band capable of encircling the border of the orifice, said fixing band further including a plurality of means for hooking the fixing components respectively.

* * * * *